US005137163A

United States Patent [19]

Moore

[11] Patent Number: 5,137,163

[45] Date of Patent: Aug. 11, 1992

[54] TAMPER EVIDENT CLOSURE WITH RAMPED CONTACT

[75] Inventor: David N. Moore, Plainfield, Ill.

[73] Assignee: Phoenix Closures, Inc., Naperville, Ill.

[21] Appl. No.: 771,615

[22] Filed: Oct. 4, 1991

[51] Int. Cl.[5] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 3,001,657 | 9/1961 | Gamble | 215/252 |
| 3,362,557 | 1/1968 | Micciche | 215/252 |
| 4,156,490 | 5/1979 | Peraboni | 215/252 |
| 4,333,577 | 6/1982 | Mumford . | |
| 4,506,795 | 3/1985 | Herr . | |
| 4,530,438 | 7/1985 | McDevitt . | |
| 4,549,667 | 10/1985 | Dullabaun . | |
| 4,550,844 | 11/1985 | Lininger . | |
| 4,567,993 | 2/1986 | Albrecht et al. . | |
| 4,579,241 | 4/1986 | Hayes . | |
| 4,756,438 | 7/1988 | Ryder | 215/252 |
| 4,807,771 | 2/1989 | Roy et al. . | |
| 4,846,361 | 7/1989 | Heffner | 215/252 |
| 4,899,898 | 2/1990 | Thompson | 215/252 |
| 4,923,073 | 5/1990 | Wilde | 215/252 |
| 4,978,016 | 12/1990 | Hayes . | |

*Primary Examiner*—Stephen Marcus
*Assistant Examiner*—Nova Stuckes
*Attorney, Agent, or Firm*—Welsh & Katz, Ltd.

[57] ABSTRACT

A tamper evident closure assembly comprising a container, a cap and a band portion. The container has a neck with threads and an annular interference ring located axially below the threads and integral with the container finish. The cap is internally threaded, having a top, a peripheral edge integral with the top and an annular skirt integrally depending from the peripheral edge. An annular tamper indicating band is detachably connected to the skirt with a plurality of spaced connectors located between the cap and the band. The band has an annular shoulder on the inside surface thereof. The annular shoulder of the band and the interference ring are configured and arranged relative to each other so that upon the application of twisting torque by the user to remove the cap from the container, the connectors are subjected to a localized vertical force, which severs the connectors sequentially and one or more at a time. After breakage of the connectors, the band remains on the neck of the container as evidence of tampering or removal.

7 Claims, 2 Drawing Sheets

TAMPER EVIDENT CLOSURE WITH RAMPED CONTACT

The present invention relates to a closure for containers and, more specifically, to a tamper-evident closure assembly including a ramped band contact.

BACKGROUND OF THE INVENTION

It is well known to provide a closure with some variation of a tamper evident, or tamper indicating assembly. These closures normally incorporate a cap portion and a band portion. The band is typically connected to the cap with a plurality of frangible bridges, or weakened tabs, that break when attempts are made to remove the cap portion. Upon removal of the cap the band is separated from the cap and remains on the container's neck. The broken bridges and separated band provide the user with evidence that the container and its contents may have been tampered with or altered.

Currently, there are various designs employed to effectuate the separation of the cap and band portions upon removal of the cap from the container. These designs typically utilize variations of a locking assembly whereby the band portion engages indentations, or notches and the like below the threading on the neck of the container to break the connectors and thereby separate the band when the cap is attempted to be removed. Similarly, there are currently a number of closure caps that utilize a camming means having an abutment or other contact point on the container surface which engages a bead-like formation integral on the inside of the band portion causing the connectors to break, leaving the band separated from the cap.

The current tamper evident closure designs sufficiently accomplish their intended purpose, that is, to provide the user with evidence of container tampering. Yet, for the average consumer, the tamper evident closure has become more of an impediment than a useful benefit. In most cases, the tamper evident closure assembly is difficult, if not impossible, to remove by merely twisting or unthreading the cap portion with the human hand. Unable to break the connectors and remove the cap as intended, many users are forced to first wedge a sharp, flattened tool, such as a knife or other kitchen utensil, between the cap and band and then tear or cut the band entirely off of the container. The difficulty in breaking the band and removing the cap in current tamper evident closures is generally the result of how the connector bridge is broken. Current tamper evident closures are designed so that all the connectors are broken simultaneously.

The problems associated with presently available tamper evident closures is particularly acute when the user is a child, elderly person, or simply physically unable to unthread the closure assembly. In addition, many of the present tamper evident closures provide hardened plastic ribs or grooves on the sides of the top of the cap to increase the user's grip for easier unthreading. However, because of the difficulty user's encounter in removing present tamper evident closures, increased torque is applied by the user, causing the grip enhancers to cut into the user's palm, thereby causing scratches or other abrasions. In short, presently available tamper evident closures accomplish their intended tamper evident task, but are problematic and have severe disadvantages.

SUMMARY OF THE INVENTION

Accordingly, a principal object of the present invention is to provide a tamper evident closure assembly that requires less twisting torque by the user, and is therefore easy to remove.

Another object of the present invention is to provide a tamper evident closure assembly which can be removed quickly, simply and easily by the user, without the use of extraneous tools and without injury to the hand.

Yet another object of the present invention is to provide a tamper evident closure that includes a bridge of connectors between the cap and band portion, wherein the connectors break sequentially when twisting torque is applied by the user to remove the cap portion.

In accordance with the present invention, these objectives, as well as others not herein specifically identified, are achieved generally by the present tamper evident closure with a ramped band contact. The closure assembly generally comprises a typical upper cap portion connected to a lower band portion by fragile, breakable connectors that form a weakened line between the cap and band portions. The cap portion has internal threads that engage the complimentary threaded finish of the container's neck. In the preferred embodiment, the band portion incorporates an inwardly extending annular shoulder which is progressively ramped or angled in relation to the top of the closure and which extends around the circumference of the band. The annular shoulder contacts the underside of an outwardly projecting annular interference ring located on the finish of the container below the threaded portion. The contact point is at a single location between the shoulder and the interference ring thereby allowing the connectors to break sequentially, and one or more at a time, as the user unthreads the cap during first disengagement.

In an alternative embodiment, the band portion includes an annular shoulder which is uniformly level for the entire inside circumference of the band. However, the neck portion of the container surface has integral thereon an angled interference ring that functions as a ramp upon which the annular shoulder of the band contacts and rides causing the band portion to separate from the cap portion. Therefore, in either embodiment, the present invention facilitates removal of the cap portion by breaking the connectors one or two at a time when twisting torque is applied by the user to unthread the cap.

DETAILED DESCRIPTION OF THE DRAWINGS

Additional advantages and features of the present invention will become apparent from the following detailed description and claims when viewed in connection with the accompanying drawings in which:

DETAILED DESCRIPTION OF THE INVENTION

Figure 1:
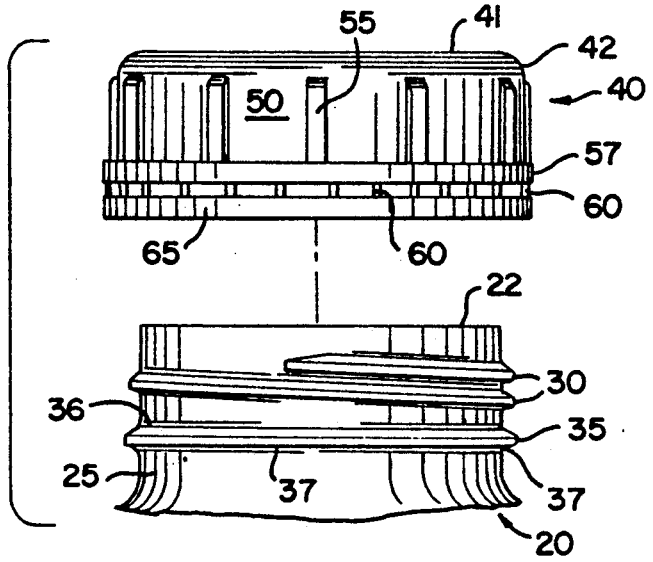
FIG. 1 is a frontal view of the tamper evident closure of the present invention shown exploded from the container's mouth.
Figure 2:
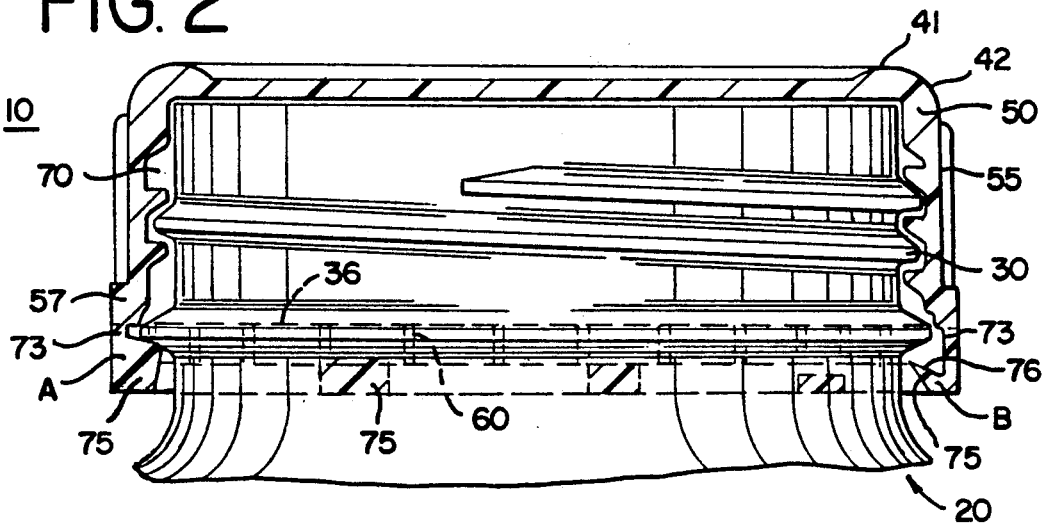
FIG. 2 is a frontal view of the present tamper evident closure of FIG. 1 shown with the ramped annular shoulder extending inwardly from the inside surface of the band portion and engaged onto the mouth of the container, the closure assembly shown in section.
Figure 3:
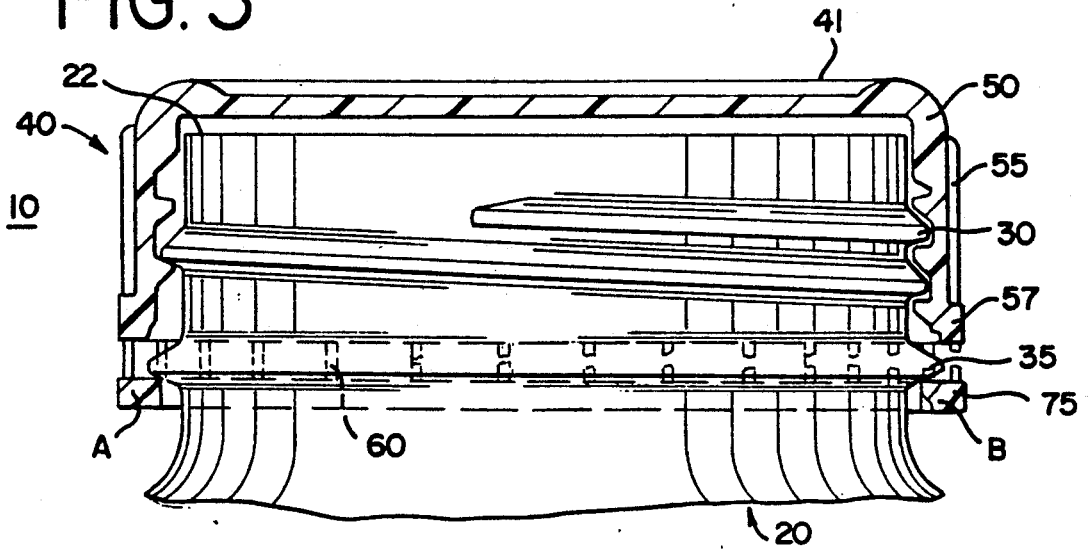
FIG. 3 is a frontal view of the present closure assembly and container mouth of FIG. 2 in which the breakaway band portion is shown disengaged from the cap portion.

Referring more particularly to the drawings, FIGS. 1-3, the invention is generally referred to as the closure assembly 10. In FIG. 1, the container 20 is shown exploded from the closure cap 40 of the present invention. The container 20 includes a mouth portion 22 and an integral neck portion 25 having molded integrally thereon external threads 30. The container neck 25 also has integrally thereon an annular interference bead or ring 35 which is positioned axially below the threads 30. Interference ring 35 has an upper contact surface 36 and lower contact surface 37. The container 20 may be a typical blow molded plastic container, or the present invention will work equally as well with containers made of other materials such as glass and the like.

In the preferred embodiment, the present invention comprises a cap portion 40 having a top, or more specifically, a top closure panel 41, a peripheral edge 42 and an annular skirt or side wall 50 integrally depending from the peripheral edge 42. Annular skirt 50 can incorporate a knurled finish or grip enhancers 55. The grip enhancers 55 are shown as nodules protruding from the skirt 50, and may be vertical and equally spaced, or angled, horizontal, and variably spaced. The skirt 50 has at its lower end, opposite the top 41, an outwardly extending annular lip 57, which extends around the circumference or periphery of the skirt 50. Depending from annular lip 57 are breakable connectors, or bridges 60, which are plastic tabs that can be of a softened plastic as compared to the plastic used for the cap portion 40. Connected to the lower end of the breakable connectors 60 is a severable tamper indicating band 65.

FIG. 2 illustrates cap portion 40 threaded onto the container 20. The cap portion 40, as shown in FIG. 2, incorporates on its inside wall internal threads 70 which engage the external threads 30 on the container neck 25. The band portion 65 has formed on its inside surface 73 a ramped annular shoulder 75 made of flexible plastic which bends over the interference ring 35 when the cap is initially applied to the container. The annular shoulder 75 will generally be positioned radially inwardly from the inside surface 73 of the band portion 65. The annular shoulder has an upper surface 76 which upon initial removal of the cap 40 rides against the lower surface 37 of the interference ring 35. "Ramped" annular shoulder 75 means that the shoulder progressively declines, or inclines, in respect to a horizontal plane going through the cap 40, relative to said top 41.

Shown clearly in FIG. 2 is the ramped annular shoulder 75 engaged with the annular interference ring 35 at a contact point between upper surface 76 and lower contact surface 37. As the user applies twisting torque to remove the container cap portion 40, the ramped annular shoulder 75, located on the inside of the band portion 65, contacts with the lower contact surface 37 of the interference ring 35 at a single contact point because annular shoulder 75 is ramped from a lower-most portion, or point B progressively to a higher-most portion, or point A relative to the top panel 41. Points A and B may be diametrically opposed, substantially adjacent, equidistant or other similar arrangements.

The cap portion 40 can be removed and replaced onto the container neck 25 by using the complimentary threading 30 and 70. It should also be understood that the ramped annular shoulder 75 need not be continuous, but rather can be formed as a series of independent steps, lugs or protrusions. It is also contemplated that conventional annular sealing beads or sealing rings may be incorporated onto cap 40 to effectuate a leak proof seal between the cap portion 40 and the container 25.

Referring more specifically to FIG. 3, the cap portion 40 having had twisting torque applied by the user upon initial removal of the closure 10, is shown with bridges 60 broken as the annular shoulder 75 rides or contacts the interference ring 35 at a single contact point. As the user continues to apply twisting torque to the cap portion 40, the interference ring 35 causes the band portion 65 to separate from the cap portion 40 and break the connectors 60 sequentially and one or more at a time. Preferably, the ramped configuration will cause the connectors to break one or more at a time. The initial point of contact between annular shoulder 75 and interference ring 35 is the upper-most portion, or point A.

At each point of contact between the upper surface 76 of the ramped annular shoulder 75 and the lower contact surface 37 of interference ring 35 a vertical tearing or severing force is exerted on each of the respective connectors 60, which will result in their sequential breakage. This tearing force is a result of cap 40 being forced upwards relative to the annular shoulder 75 due to the threading 30 and 70, while the band 65 is forced downward due to the contact between the interference ring 35 and the annular shoulder 75. The vertical tearing or severing force will typically be in an axially vertical direction in relation to the cap 10 and the band 65. The severable band portion will be completely severed and left on the container neck when annular shoulder 75 has contacted with the interference ring 35 at its lowest most portion, location B.

As shown in FIG. 3, once the cap portion 40 is unthreaded the lower portion of the interference ring 35 will ride upon the annular shoulder 75 thereby causing the connectors to break one or more at a time, preferably one or two at a time. As shown, some of the connectors 60 have been broken since the upper-most portion of annular shoulder 75, beginning at point A, has made contact with interference ring 35. Finally, the band 65 will remain on the neck 25 of the container 20 after all of the connectors 60 are broken as evidence of tampering or removal of the closure 10.

It is contemplated that a conventional capping method will be used to initially engage the closure 10 to the container 20. The method would comprise screwing the cap 40 onto the container 20 whereby the threads 30 engage the container threads 70 and the band 65 with the annular shoulder 75 snapping over the interference ring 35. Hence, the annular shoulder 75 may need to be configured to be sufficiently flexible to snap over the interference ring 35 without breakage.

Furthermore, it should be understood that the configuration of the interference ring 35 and the annular shoulder 75 will cause the cap 40 to fit more securely onto the container 20. Referring to FIG. 2, after the container 20 has been capped with the closure 40, the higher most portion, location A, will be in contact with the lower contact surface 37 of the interference ring 35. The contact point creates a vertical holding force which increases the engagement between the closure 40 and the container 20 by forcing the cap 10 axially downwards towards the container 20 prior to removal of the closure 10.

Figure 4:
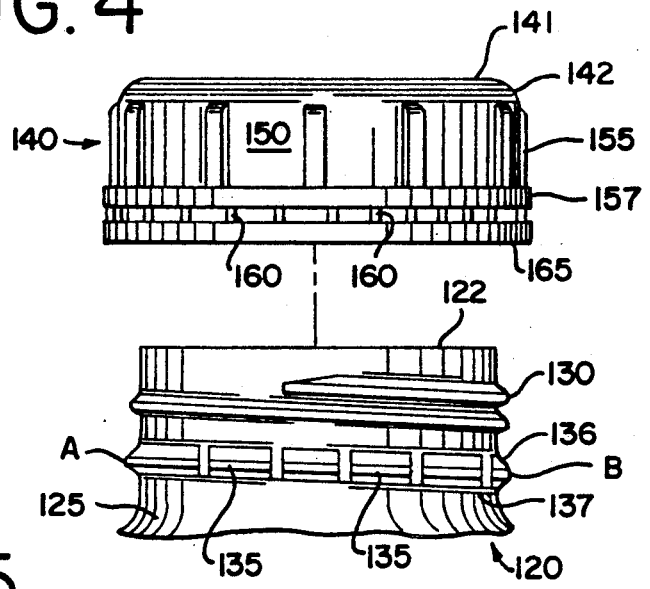
FIG. 4 is an exploded frontal view of an alternative embodiment of the tamper evident closure of the present invention shown with the ramped interference ring integrally on the neck of the container.
Figure 5:
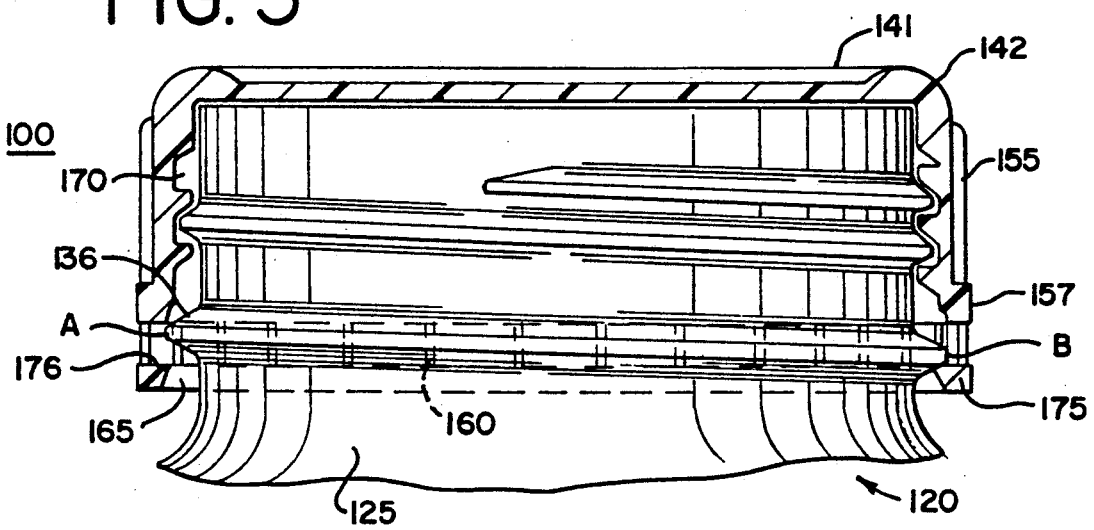
FIG. 5 is a frontal view of the alternative closure assembly of the present invention of FIG. 4 shown engaged onto the mouth of the container, the closure assembly shown in section.
Figure 6:
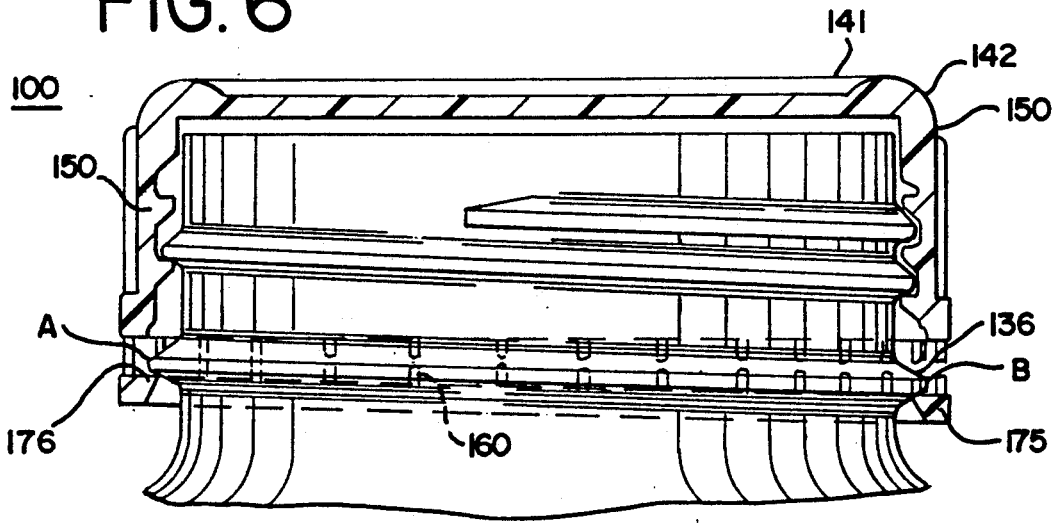
FIG. 6 is a frontal view of the alternative closure assembly and container mouth of FIG. 5 in which the break-away portion is shown disengaged from the cap portion.

The alternative embodiment, as depicted in FIGS. 4–6, is generally referred to as the closure assembly 100. Essentially, the alternative embodiment comprises the same elements as the preferred embodiment. The cap 140 includes a top or top closure panel 141, a peripheral edge 142 and an annular skirt 150 integrally depending from the peripheral edge 142. Annular shirt 150 has a knurled finish, or integral grip enhancers 155. The annular depending skirt 150 also has at its lowest most portion an annular lip 157 which extends around the periphery of the annular skirt 150. A severable band portion 165 is integrally connected to the annular lip 155 with breakable bridges or connectors 160.

The container 120, has integrally located on its neck 125 external threads 130. The cap portion 100 has on the inner surface of the depending skirt 150 internal threads 170 for releasable engagement with the threading 130. The band portion 165 has a radially inwardly extending annular shoulder 175 integral to its inside surface. The annular shoulder 175 has an upper contact surface 176. In this embodiment the annular shoulder 175 is uniformly level relative to a horizontal plane going through the cap 140 relative to the top 141. However, unlike the interference ring 35 of the preferred embodiment, the interference ring 135 of the alternative embodiment is progressively angled or ramped relative to the top 141 and a horizontal plane through the cap 140. The interference ring 135 has an upper contact surface 136 and a lower contact surface 137.

As in the preferred embodiment, as the user unthreads the cap portion 100 the interference ring 135 contacts with the annular shoulder 175. The annular shoulder 175 can be configured as one continuous element or can be a series of lugs or protrusions. In FIGS. 4 and 5, A represents one possible location for the higher-most point, while B represents one possible location of the lower-most point of the interference ring 135. Essentially, the annular shoulder 175 contacts with the ramped interference ring 135 at a single point as the cap portion 140 is unthreaded and forced upwards. As the user continues to unthread the cap portion 140 the annular shoulder 175 on the inside of the severable band portion continues to contact the angled interference ring 135 thereby causing the cap portion to separate from the band portion and break the connectors sequentially, or one or more at a time, in respect to the contact point. As shown in FIG. 6, as the cap portion 140 is unthreaded, the connectors 160 are broken and the breakaway band 165 will remain on the container neck below the interference ring 135, as evidence of tampering or removal.

While a particular embodiment of the tamper evident closure with ramped band contact of the invention has been shown and described, it will be appreciated by those skilled in the art that changes and modifications may be made thereto without departing from the invention in its broader aspects and as set forth in the following claims.

What is claimed is:

1. A combination tamper evident closure assembly and container comprising:

a container having a mouth and a neck with threads thereon, said container neck having a ramped, annular interference ring located axially under said threads and integrally formed on the container finish;

a cap having a top, a peripheral edge integral with said top and an annular skirt integrally depending from said peripheral edge;

said skirt having internal threads integrally formed thereon configured to engage with said threads on said container neck;

an annular tamper indicating band detachably connected to said skirt with a plurality of spaced connectors between said cap and said band;

said band having an annular shoulder on the inside surface thereof;

said ramped interference ring having an upper-most end beginning at a point along a vertical plane extending through said container neck, said upper-most end gradually declining along substantially all of the circumference of said container neck to a point substantially adjacent said upper-most end along said vertical plane; and said annular shoulder of said band and said ramped interference ring configured and arranged relative to each other so that upon the application of twisting torque by the user to remove said cap from said container said connectors are subjected to a localized vertical force beginning at said point adjacent said upper-most end, which severs said connectors sequentially from the point of initial severance, thereby leaving said band on said neck of said container as evidence of tampering or removal.

2. A closure as described in claim 1 wherein said interference ring has a lower contact surface and said annular shoulder has an upper surface, said lower contact surface of said interference ring contacts the upper surface of said annular shoulder on said band when twisting torque is applied by the user upon removal of said cap from said container.

3. A closure as described in claim 2 wherein as said cap is unthreaded said annular shoulder contacts said lower contact surface of said interference ring and thereby forces said band increasingly away from said cap, causing said connectors relative to said contact point to break.

4. A closure as described in claim 1 wherein said cap has a knurled finish for increasing the user's grip when applying a twisting torque to said closure upon removal of the cap from the container.

5. A combination tamper evident closure assembly and container comprising:

a blow-molded plastic container having a mouth portion and a neck portion with external threads integrally formed thereon;

a cap having a top, a peripheral edge and a depending skirt integral with said peripheral edge;

a severable band depending from and connected to said skirt with a plurality of circumferentially spaced bridges;

said band having integrally on its inside surface an annular shoulder;

a ramped annular interference ring positioned axially below said threads on said neck, said ramped interference ring being configured and positioned so that when said cap is initially removed from said container said annular shoulder contacts said interference ring at a single point creating a vertical tearing force which causes said bridges to break sequentially from the point of initial severance and one at a time; and said ramped interference ring having an upper-most end beginning at a point along a vertical plane extending through said neck, said upper-most end gradually declining along substantially all of the circumference of said neck to a second point diametrically opposed from said upper-most end.

6. The combination as described in claim 5 wherein said ramped interference ring has a lower contact surface and said annular shoulder has an upper contact surface, said lower contact surface of said ramped interference ring progressively contacting said upper contact surface of said annular shoulder at a contact point beginning at said second point, thereby maintaining a continuous force increasingly separating said band away from said cap and causing said connectors relative to said contact point to break one at a time.

7. The combination as described in claim 5 wherein said ramped interference ring is one continuous formation.

* * * * *